US005650617A

United States Patent [19]

Mordehai

[11] Patent Number: 5,650,617

[45] Date of Patent: Jul. 22, 1997

[54] METHOD FOR TRAPPING IONS INTO ION TRAPS AND ION TRAP MASS SPECTROMETER SYSTEM THEREOF

[75] Inventor: Alex Mordehai, Mountain View, Calif.

[73] Assignee: Varian Associates, Inc., Palo Alto, Calif.

[21] Appl. No.: 688,469

[22] Filed: Jul. 30, 1996

[51] Int. Cl.[6] ..... H01J 49/42

[52] U.S. Cl. ..... 250/290; 250/291; 250/292

[58] Field of Search ..... 250/290, 291, 250/292, 293, 281, 282, 283

[56] References Cited

U.S. PATENT DOCUMENTS

| | | | |
|---|---|---|---|
| 3,065,640 | 11/1962 | Langmuir et al. | 73/517 |
| 4,736,101 | 4/1988 | Syka et al. | 250/292 |
| 4,924,089 | 5/1990 | Caravatti | 250/290 |
| 5,268,572 | 12/1993 | Mordehai et al. | 250/289 |
| 5,302,827 | 4/1994 | Foley | 250/292 |
| 5,399,857 | 3/1995 | Doroshenko et al. | 250/292 |
| 5,468,958 | 11/1995 | Franzen et al. | 250/292 |

OTHER PUBLICATIONS

Article by Chun-Sing O and Hans A. Schuessler, entitled "Confinement of Ions Injected Into a Radiofrequency Quadrupole Ion Trap: Pulsed Ion Beams of Different Energies", published in *International Journal of Mass Spectrometry and Ion Physics, 40 (1981)*, pp. 54–66.

E. N. Nikolaev et al., "High-resolution Ion Partitioning Technique for a One-section Ion-cyclotron-resonance Spectrometer Cell", *Rapid Communications in Mass Spectrometry, vol. 4, No. 2 (1990)*, pp. 64–66.

A. V. Mordehai et al., "Mechanism of Ion Capture into the ICR Cell by Off-resonance Excitation Field", *Les Cahiers de Spectra, Supplement Au No. 150*, Sep. 1990, pp. 25–26.

Steven C. Beu et al., "Improved Fourier-Transform Ion-Cyclotron Resonance Mass Spectrometry of Large Biomolecules", *Journal of the American Society for Mass Spectrometry*, Nov. 24, 1992, pp. 190–192.

Alex V. Mordehai et al., "A Novel Differentially Pumped Design for Atmospheric Pressure Ionization-Ion Trap Mass Spectrometry", *Rapid Communications in Mass Spectrometry, vol. 7*, Jan. 1993, pp. 205–209.

Shenheng Guan et al., "Ion Traps for Fourier Transform Ion Cyclotron Resonance Mass Spectrometry: Principles and Design of Geometric and Electric Configurations", *International Journal of Mass Spectrometry and Ion Processes*, 146/147 (1995), pp. 261–296.

*Primary Examiner*—Jack I. Berman
*Assistant Examiner*—Kiet T. Nguyen
*Attorney, Agent, or Firm*—Bella Fishman

[57] ABSTRACT

A method and mass spectrometer system for trapping ions within an ion trap by increasing the flight path of ions therein. An ion beam is produced by external ion source and is directed to the ion trap which comprises at least one trapping electrode in proximity to an exit region of the ion beam from the ion trap. A retarding DC voltage is applied to the trapping electrode during ion accumulation time for creating a fringing reflection field and for retaining ions within the ion trap.

27 Claims, 10 Drawing Sheets

METHOD FOR TRAPPING IONS INTO ION TRAPS AND ION TRAP MASS SPECTROMETER SYSTEM THEREOF

FIELD OF THE INVENTION

This invention is related to the area of ion trap mass spectrometry, including ion cyclotron resonance mass spectrometry (ICR) and quadrupole ion trap mass spectrometry, and, more particularly, to the techniques of trapping ions into ion traps and ion trap mass spectrometer systems.

BACKGROUND OF THE INVENTION

Ion cyclotron resonance mass spectrometry and quadrupole ion trap mass spectrometry are based on the trapping and confining of ions in a localized volume of space using an electromagnetic field. In the case of ion cyclotron resonance, the trapping field is a combination of a static electric field and a magnetic field which creates the so-called Penning type trap. In the case of a quadrupole ion trap, the trapping field is an alternating electrical field and this trap is known as a Paul ion trap. In general the trapping action for both kinds of ion traps can be described as a pseudo-potential well for ions. If ions are formed inside of the trap, in the center of the potential well, then the trapping efficiency can theoretically be as high as 100% since ions do not have the energy to leave the potential well. However for practical purposes it is often beneficial to have an ion source externally located with respect to the trap when ions have to be injected into the trap. The externally produced ions have kinetic energy exceeding that necessary to escape the trap and therefore only a small number of the ions can be trapped resulting in low trapping efficiency.

External ion introduction has become a conventional and very powerful tool in ion trap mass spectrometry. The process of ion injection into an ion trap with high efficiency is crucial for the final sensitivity of the technique. In early ion injection attempts, off-axis ion ejection was suggested to improve trapping efficiency for the quadrupole radio frequency ion trap (O. C.-S., Schuessler, H. A. Confinement of Pulse-Injected External Ions in a Radio-Frequency Quadrupole Ion Trap, Int J. Mass Spectrom. Ion Phys.,1981, v 40, p.53–86). A similar approach was later introduced for ICR traps (P. Caravatti, U.S. Pat. No. 4,924,089). Off-axis ion injection results in a longer ion path inside the trap and a higher probability for an ion to lose energy as a result of a collision with a neutral gas molecule, and thus a higher trapping efficiency compared to the axial ion introduction.

For enhancing the trapping efficiency, a buffer gas pulsation was used to slow down ions inside the trap by means of collisions with buffer gas molecules. In this technique, one problem was the complexity of the vacuum system which used a pulsed valve for the buffer gas introduction (S. Beu et at., J.Am. Soc. Mass Spectrom. 1993, 4, 190–192). Another problem associated with this approach is the reproducibility of its results apparently due to problems with pressure control during buffer gas pulse. The pulsing of the trapping field has been used both for the ion cyclotron resonance (E. N. Nikolaev et at., Rapid Com. Mass. Spectrom., v.5, pages 260–262, 1991) and for quadrupole ion traps (U.S. Pat. Nos. 3,065,640 D. B. Langmuir et al. and 5,399,857 Doroshenko et at.,). These techniques work well for short bursts of ions, i.e. pulsed ion sources, but provide poor trapping efficiency for a continuous ion beam.

In a different approach to ion trapping, an additional radio-frequency field was superimposed on the main trapping field to improve ion trapping efficiency (A. Mordehai et al., Les Cahiers de Spectra, ISSN-0399-1172, No. 150, p.25, 1990). In this technique the additional radio-frequency electric field with mass specific frequency was utilized to increase trapping efficiency, however it was efficient only for a narrow range of mass-to-charge ratios.

All the above described ion trapping methods can be classified as active trapping techniques. There are several passive trapping techniques which are used when the ion trap is pressurized at a compromise pressure determined by adequate trapping efficiency and sensitivity while maintaining required mass resolution. For example, in the U.S. Pat. No. 5,268,572, Mordehai et al., the ion detector was placed in the differentially pumped vacuum chamber and the trap was pressurized up to $10^{-2}$ Torr to achieve efficient cumulative ion trapping. The standard ion trap scan technique (Kelley et al., U.S. Pat. No. 4,736,101) was used for ion detection. A trapping efficiency of about 10% has been reported in this method and only 50% of the trapped ions were actually detected (A. Mordehai et at., Rapid Comm. in Mass Spec., v.7, p.205–209, 1993).

There were also several different trap designs which were proposed to modify the electrical field in the trap during different modes of operation. A quadrupole ion trap with split end caps was developed to switch on and off the high order multipole fraction of the radio-frequency field (Franzen et al., U.S. Pat. No. 5,468,958). Several different ICR traps were suggested recently for specific applications (S. Guan et al., Int. J. Mass Spec. and Ion Proc., v. 146/147, 1995, p. 261). None of the previously developed traps were designed for optimum trapping of externally produced ions and thus provided low trapping efficiency with external ion sources.

In all prior art, trapping efficiency for cumulative trapping of externally produced ions of a wide mass range is extremely small (typically below 10%), thus resulting in poor overall sensitivity.

SUMMARY OF THE INVENTION

It is an advantage of the present invention that ion traps have variable trapping field geometry for ion accumulation and ion detection.

It is an object of the present invention to provide a method for trapping ions from an external ion source during accumulation time into ion traps with improved ion trapping efficiency.

It is another object of the present invention to provide an ion trap mass spectrometer system to perform improved ion trapping and analyzing method.

It is an advantage of the present invention that an electrostatic fringing field is created inside the ion trap at an opposite side of the entrance thereto to reflect an ion beam and enhance ion trapping efficiency.

In accordance with the present invention there is provided an improved ion trap mass spectrometer system which comprises an external ion source for producing an ion beam and ion trap for trapping and analyzing ions therein. The ion trap has entrance and exit regions for passing ions therethrough provided with at least one trapping electrode which is placed in proximity to the exit region from the ion trap. The mass spectrometer system further comprises a power supply for applying a retarding DC voltage to the trapping electrode for creating a fringing reflecting field within the ion trap during an ion accumulation time and applying a bias DC voltage to the trapping electrode during an ion detection time.

In accordance with different aspects of the present invention the trapping electrode may be positioned inside or outside the ion trap, and on or off an ion beam axis. The trapping electrode of one embodiment has a hollow body with a central orifice. The trapping electrode of another embodiment is formed as an isolated portion of an exit electrode of the ion trap.

In accordance with yet another aspect of the present invention there is provided a method of analyzing ions within the ion trap. When ions produced by the external ion source are trapped in the ion trap with the assistance of the fringing reflecting field which is created at the exit region of the ions from the ion trap.

The ions are produced by the external ion source and directed into the ion trap through the entrance region. The ion trap is filled with a buffer gas. For effectively trapping ions within the ion trap, a retarding DC voltage is applied to the trapping electrode within the exit region during ion accumulation time. Then the retarding DC voltage is switched off, and a bias DC voltage is applied to the trapping electrode during detection time. To enhance the ion extraction process, a supplemental RF voltage is applied to the ion trap.

The foregoing and other object features and advantages of the present invention will become apparent from the following detailed description of the preferred embodiments, taken together with the accompanying drawings.

DESCRIPTION OF THE PREFERRED EMBODIMENTS

Figure 1:
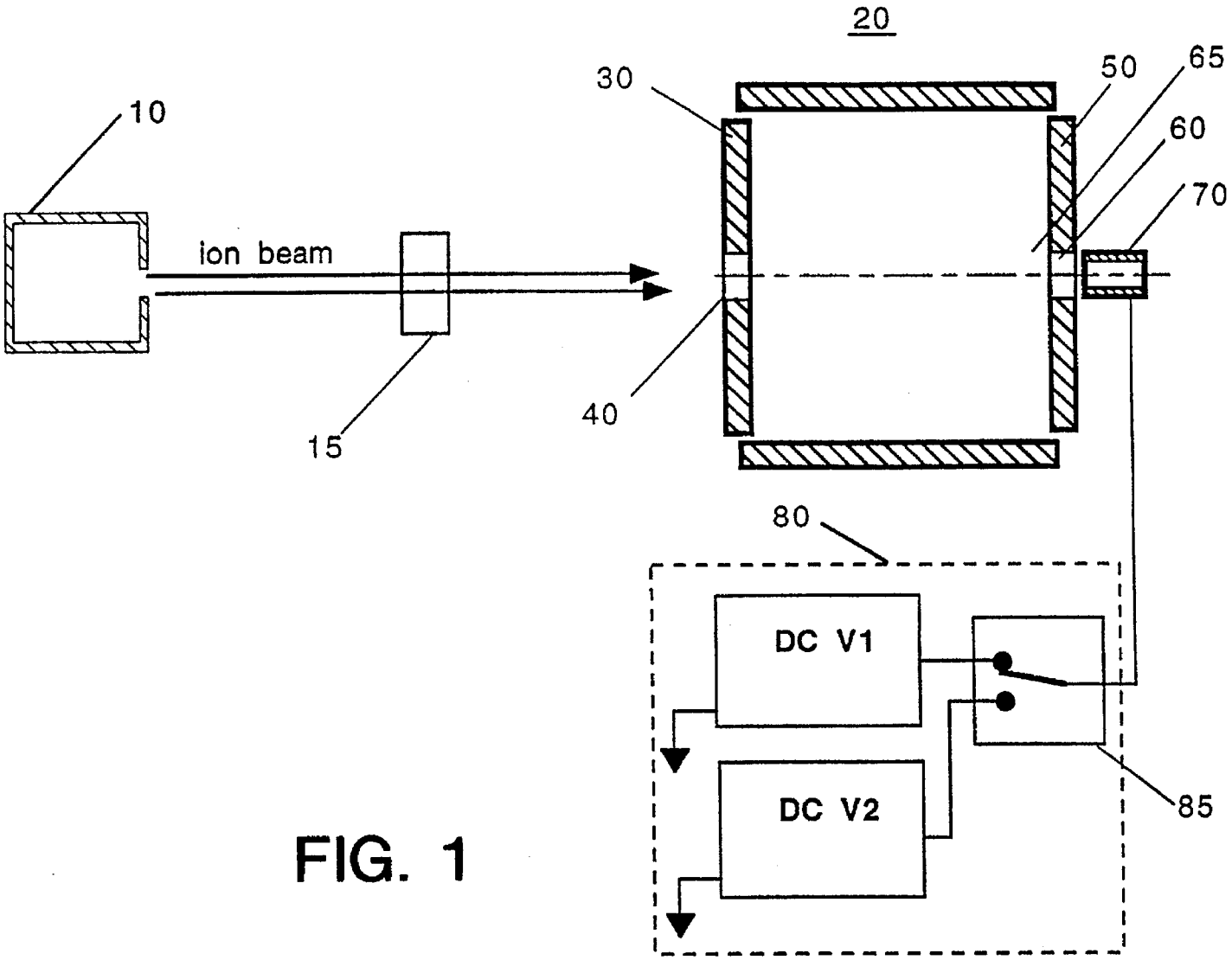
FIG. 1 shows a schematic illustration of an ion trap mass spectrometer system of the present invention.

Referring to FIG. 1, an ion trap mass spectrometer system of the present invention comprises external ion source 10; ion trap 20 having entrance electrode 30 with entrance aperture 40 and exit electrode 50 with exit orifice 60; trapping electrode 70 and DC power supply 80 for applying DC voltage to trapping electrode 70.

According to the present invention, an ion beam is generated by external ion source 10. The ion beam is admitted into ion trap 20, such as an ion cyclotron resonance cell or quadrupole radio-frequency ion trap, by ion optical gating device 15 for an ion accumulation time interval. The ion beam is directed into ion trap 20 through entrance aperture 40 of entrance electrodes 30. The direction of the ion beam defines ion exit region 65 located at the opposite side of the ion trap with respect to ion entrance aperture 40. Trapping electrode 70 is positioned in proximity to ion exit region 65. A retarding DC potential produced by DC power supply 80 is applied to trapping electrode 70 to create an electrostatic retarding field locally at ion exit region 65 to prevent ions from exiting ion trap 20 and to improve trapping efficiency. This potential is applied only during ion accumulation time to provide an electrostatic retarding field at the ion exit region which is strong enough to stop and reflect ions back into the ion trap. When the process of accumulating ions within the trap is completed, ion gating device 15 is turned off and the DC retarding potential on the trapping electrode is switched off by switch 85 to remove the electrostatic retarding field and DC bias potential is applied to trapping electrode 70.

Figure 2:
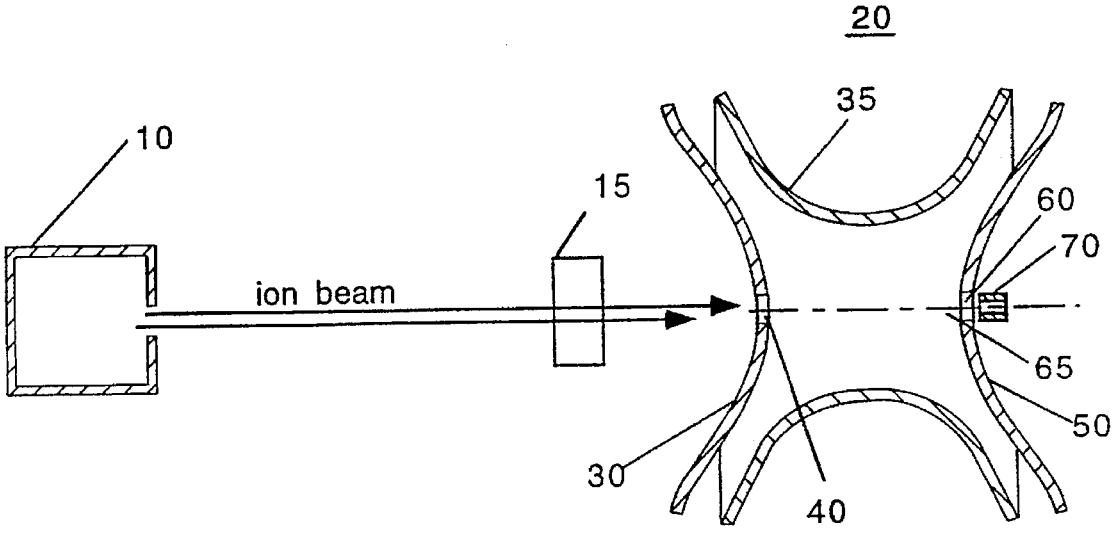
FIG. 2 shows a schematic illustration of the ion trap mass spectrometer system of the present invention utilizing a three dimensional quadrupole ion trap with two hyperbolically shaped entrance and exit electrodes and a central complimentary shaped ring electrode.

In the preferred embodiment of the invention as shown in FIG. 2, ion trap 20 is a three dimensional quadrupole ion trap comprising two hyperbolically shaped end cap elctrodes 30, 50, and central complimentary shaped ring electrode 35. The ion beam is generated by external ion source 10 and is directed into the ion trap through entrance aperture 40 of the entrance end cap 30. Trapping electrode 70 is installed in proximity to ion exit region 65. The ion beam is admitted into the ion trap for a predetermined period of time, i.e. ion accumulation time, by opening ion optical gating device 15. Ions from the external ion source enter the ion trap with low kinetic energy in a range between 0 and 50 V. The main trapping field is created by applying an RF voltage to the central ring electrode 35. In the experiments provided, the RF voltage of about 600 V peak-to-peak at 1 Mhz was applied to the central ring electrode with characteristic radius $R_0$=1 cm. The ion trap is pressurized to about $10^{-3}$ Torr with a buffer gas such as helium to promote ion trapping. During the accumulation time, the trapping electrode is under the retarding DC potential of about +100 V for providing a substantial retarding electrical field preventing ions from exiting the ion trap on their way through. The optimal value of the applied potential depends on the ion electrodes configuration. It is understood that the radio-frequency quadrupole ion traps can be of geometries different from hyperbolic including but not limited to cubic and cylindrical geometries. Ion optical gating device 15 may be an optical element of the system depending on the type of the ion source used for producing ions. It is necessary to install it for continuous external ion sources such as electrospray, electron ionization, or inductively coupled plasma ion sources. For pulsed ionization ion sources such as a laser desorption ion source this element can be omitted.

Figure 3B:
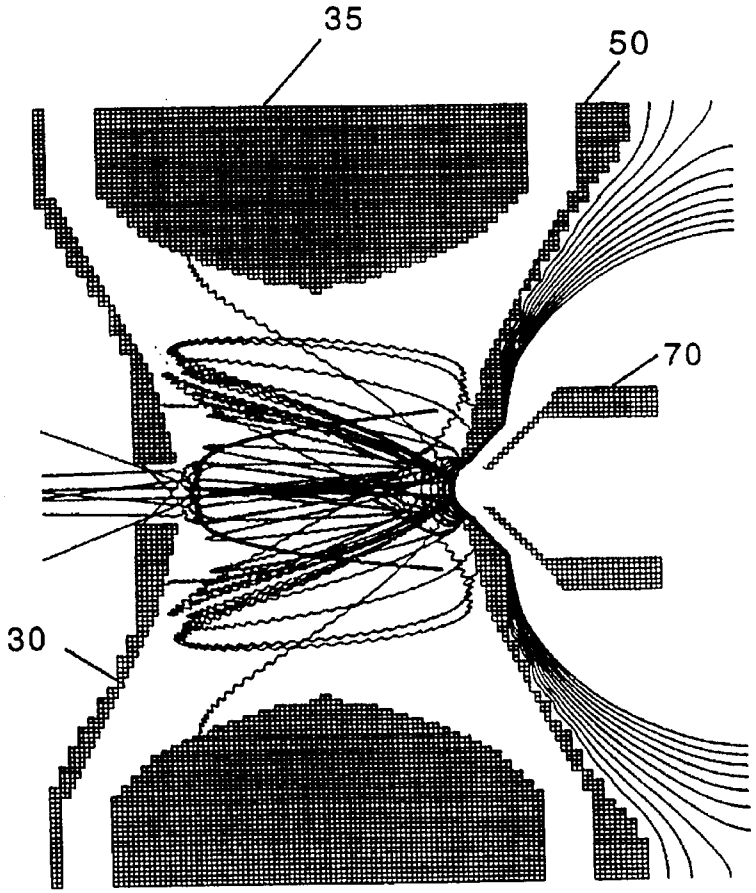
FIGS. 3*a* and 3*b* show two respective simulated ion motion plots for trapping of externally produced ions with no trapping electrode according to prior art ion trap systems and with a trapping electrode according to the present invention.
Figure 3A:
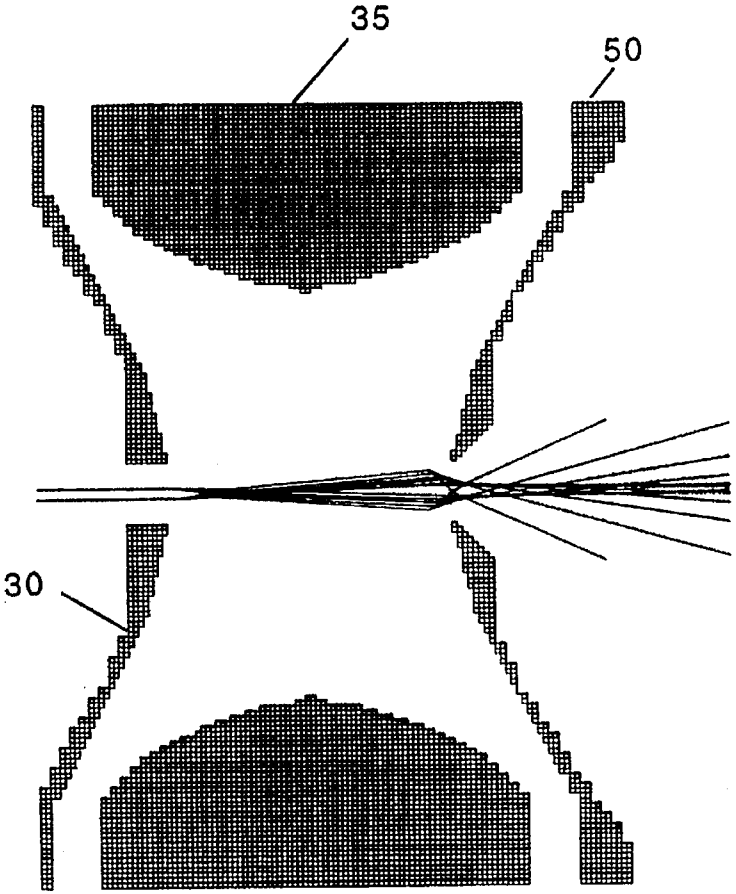
FIG. 3A PRIOR ART
Figure 4A:
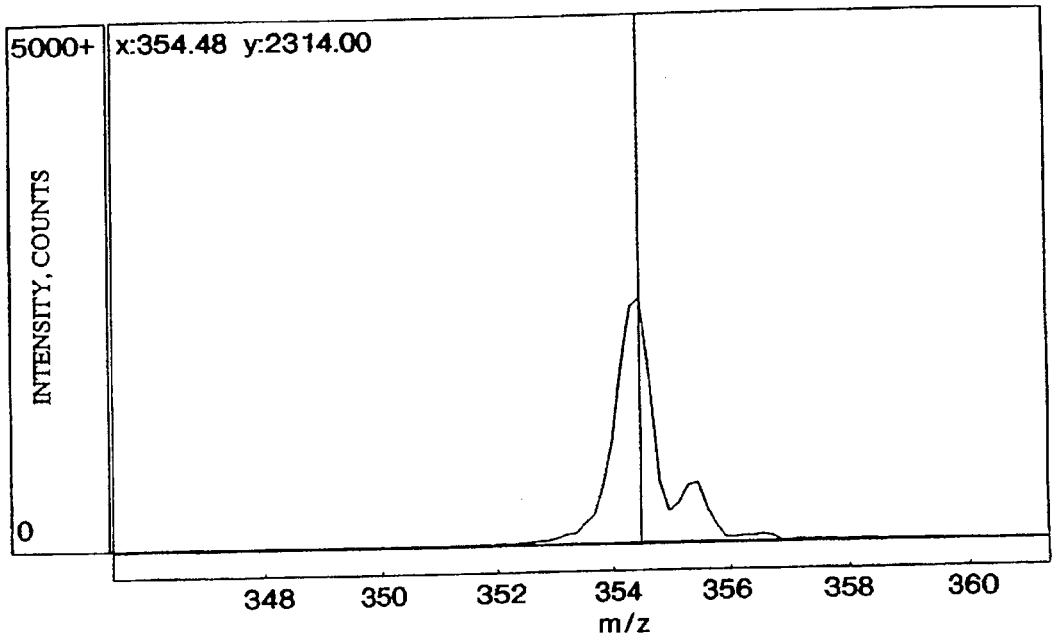
FIG. 4A PRIOR ART
FIGS. 4*a* and 4*b* show respective experimental mass spectral data of ion trapping and analyzing techniques according to prior art and the claimed invention.
Figure 4B:
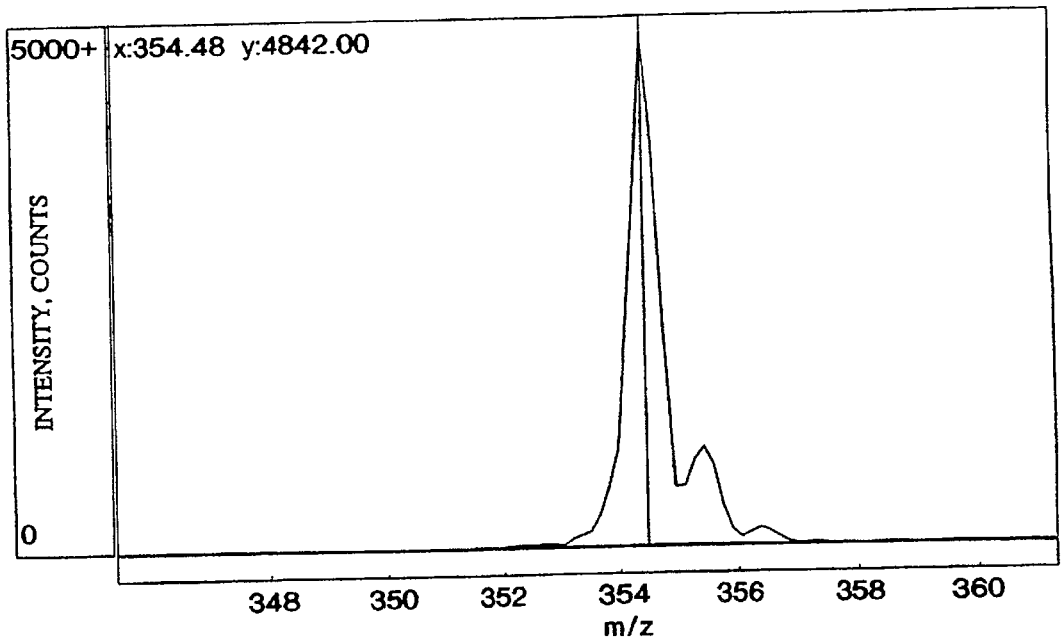

FIGS. 3*a* and 3*b* show two simulated plots obtained with SIMION software (D. Dahl, Idaho National Labs) for the trapping of externally produced ions into three dimensional quadrupole ion trap with no trapping electrode of prior art and with the trapping electrode of present invention respectively. An RF voltage of 750 V in amplitude at 1 MHz was applied to ring electrode 35 and a retarding DC potential of 60 V. Sixteen trajectories of ion motions are presented in each plot. Two sets of eight ion trajectories have the same starting point of motion symmetrically located around a central axis of the ion trap. Each set of eight ion trajectories represents energies in the intervals between 4 to 12 eV at 1 eV increments. Ion-neutral collisions with buffer gas were not considered for computer simulations. The probability for an ion to have a collision with a buffer gas molecule, as well as the probability of becoming trapped, is proportional to the total ion flight path without collision (R. E. March, R. J. Hughes, Quadrupole Storage Mass Spectrometry, ch. 4.VI, 1989, John Willey & Sons, Inc). As shown in FIG. 3*a*, in the prior art technique the ion path in the trap is very short, therefore ions fly through untrapped. As shown in FIG. 3*b*, in the present invention a fringing field at exit end cap 50 is strong enough to reflect ions back into the ion trap, dramatically increasing the ions flight path therein. The trapping of external ions utilizing the fringe field trapping electrode of the present invention is substantially greater since the trapping efficiency is proportional to the total flight path. The increased ion path inside the trap also allows one to operate at significantly lower buffer gas pressures without compromising other characteristics of the system. In the experiments, the improved mass spectrometer system with trapping electrode positioned as shown in FIG. 3*b* was used for trapping and analyzing ions with prior art techniques and the technique of the claimed invention. The respective experimental mass spectral data for trapping and analyzing ions with conventional and claimed methods is represented in FIGS. 4*a* and 4*b*. The ion beam was produced by electrospray ion source utilitzing a sample solution of tetrahexyl ammonium bromide of 100 pM/ml in methanol. Ions were accumulated within the ion trap during 10 ms. The ion trap was pressurized with helium gas to a pressure of about $10^{-3}$ Torr. Data shown in FIG. 4*a* is obtained when the trapping electrode has a ground potential during accumulation time. The mass spectrum of FIG. 4*b* is obtained when 100 V of DC voltage is applied to the trapping electrode. The relative ion peak intensity in FIG. 4*a* is equal to 2314, while the relative ion peak intensity in FIG. 4*b* is equal to 4842.

Figure 5A:
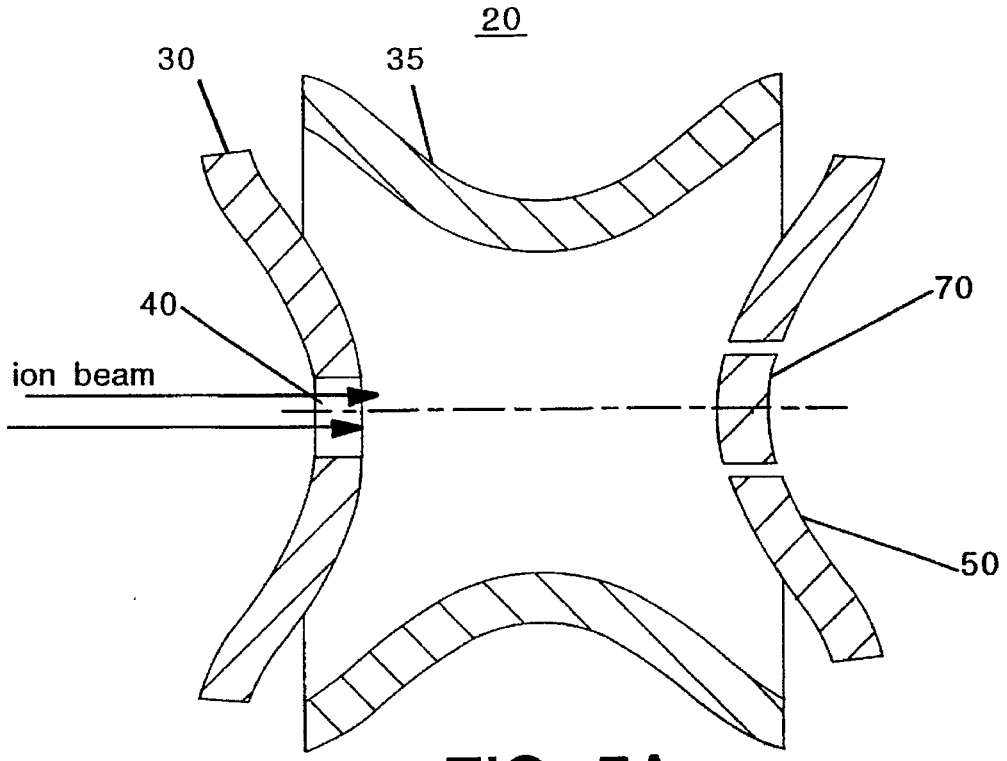
FIG. 5*a* shows a trapping electrode which is placed on an ion beam axis and formed as an isolated central portion of an exiting electrode of an ion trap.
Figure 5B:
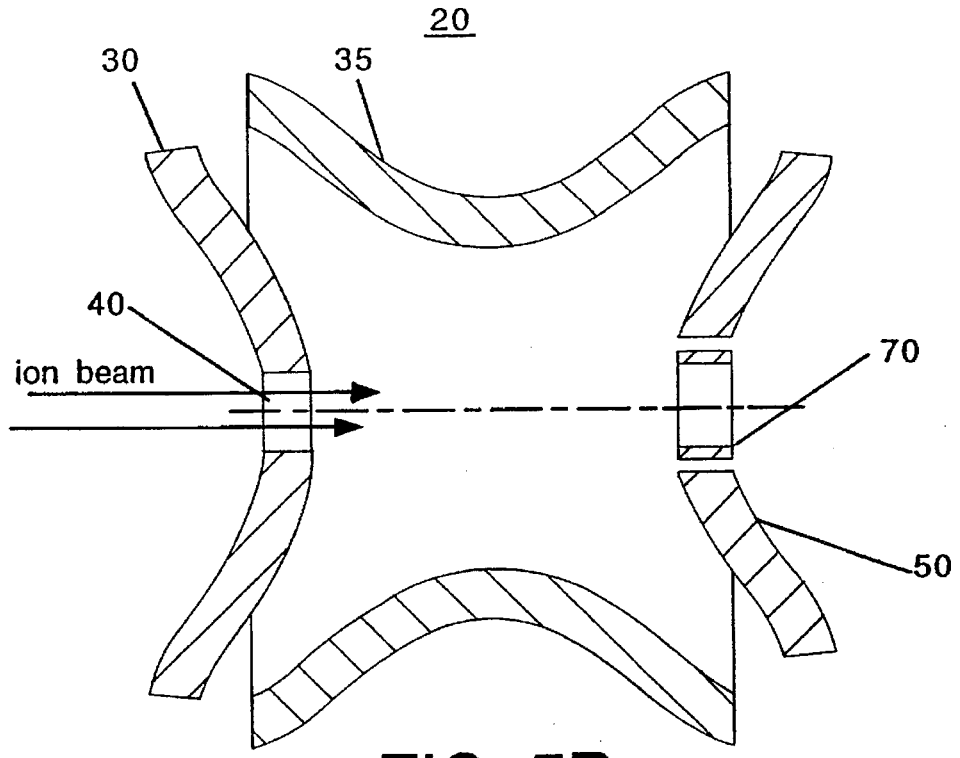
FIG. 5*b* shows a trapping electrode which is placed on the ion beam axis and formed as an isolated central portion of the exciting electrode of the ion trap with a channel therethrough.
Figure 5C:
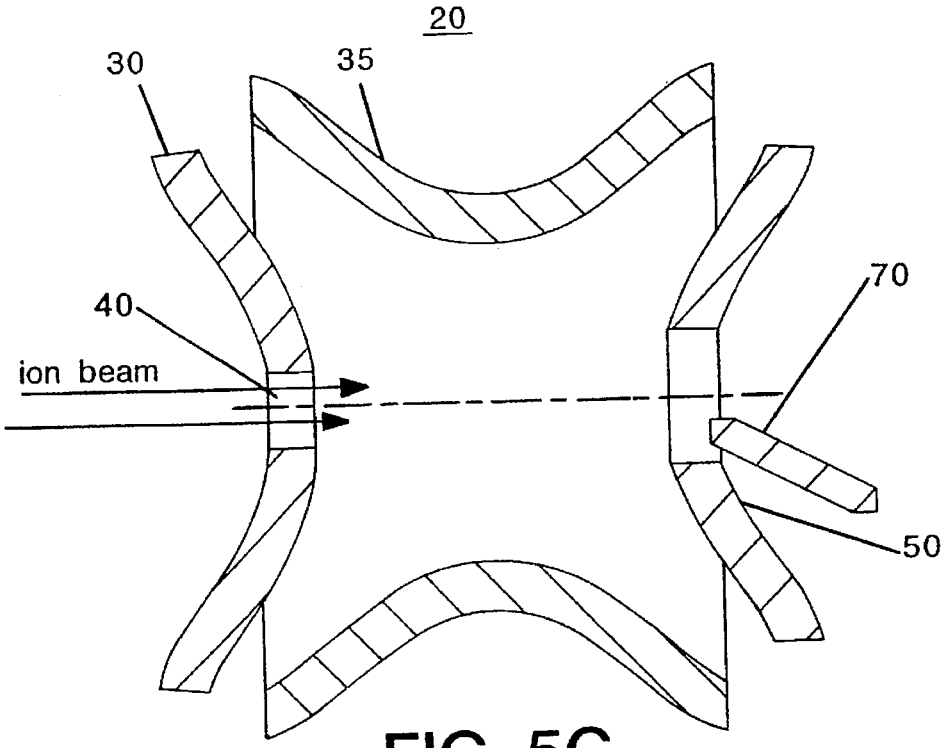
FIG. 5*c* shows a trapping electrode which is placed off the ion beam axis in proximity to the ion beam exit from the ion trap.
Figure 5D:
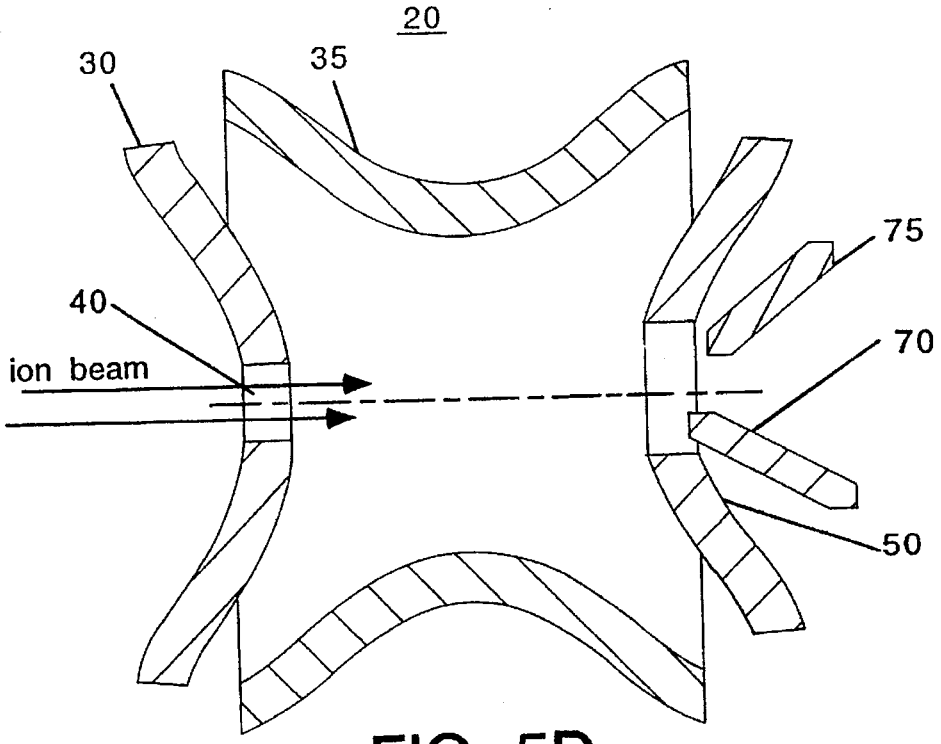
FIG. 5*d* shows a pair of trapping electrodes which are placed within the ion beam exit from the ion trap.
Figure 5E:
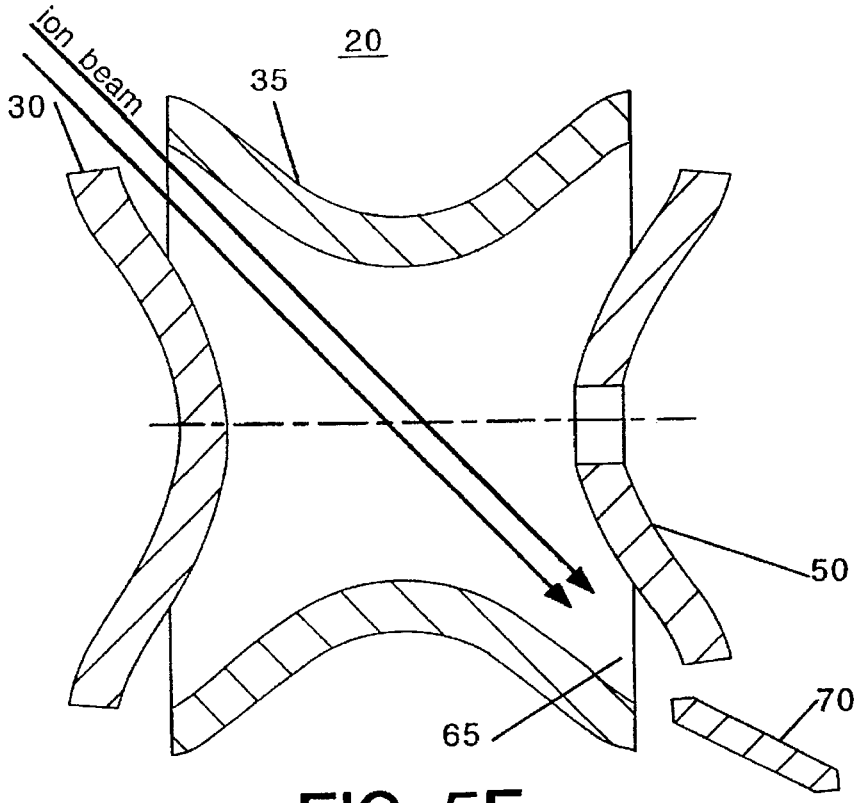
FIG. 5*e* shows the ion trap with a diagonal introduction of the ion beam therein and a trapping electrode which is placed in proximity to the ion beam exit of the ion trap.
Figure 5F:
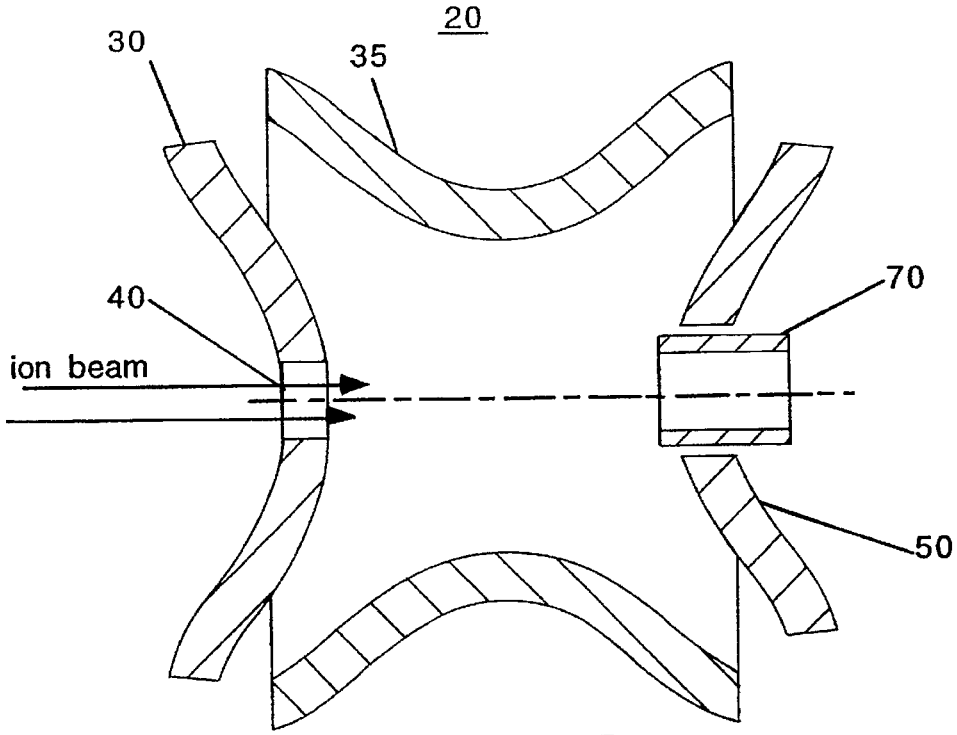
FIG. 5*f* shows a trapping electrode of a tube design which is placed in proximity to the ion beam exit inside the ion trap.

The examples of different configurations of the ion trap with the trapping electrode are shown schematically in FIGS. 5*a*, 5*b*, 5*c*, 5*d*, 5*e* and 5*f*. As shown in FIG. 5*e*, the direction of ion introduction does not have to coincide with the geometrical axes of the trap. As shown in FIG. 5*d*, several trapping electrodes with different adjustable DC voltages can be used to provide independently the efficient retarding field during ion trapping and optimum field configuration during ion detection.

After ions are accumulated in the ion trap, the trapping electrode potential is adjusted to remove the retarding fringing field and ion gating device 15 is turned off. When the fringing field of the trapping electrode 70 is off, the ion trap is functionally identical to the original Paul trap and it can perform all the conventional ion trap functions.

Figure 6:
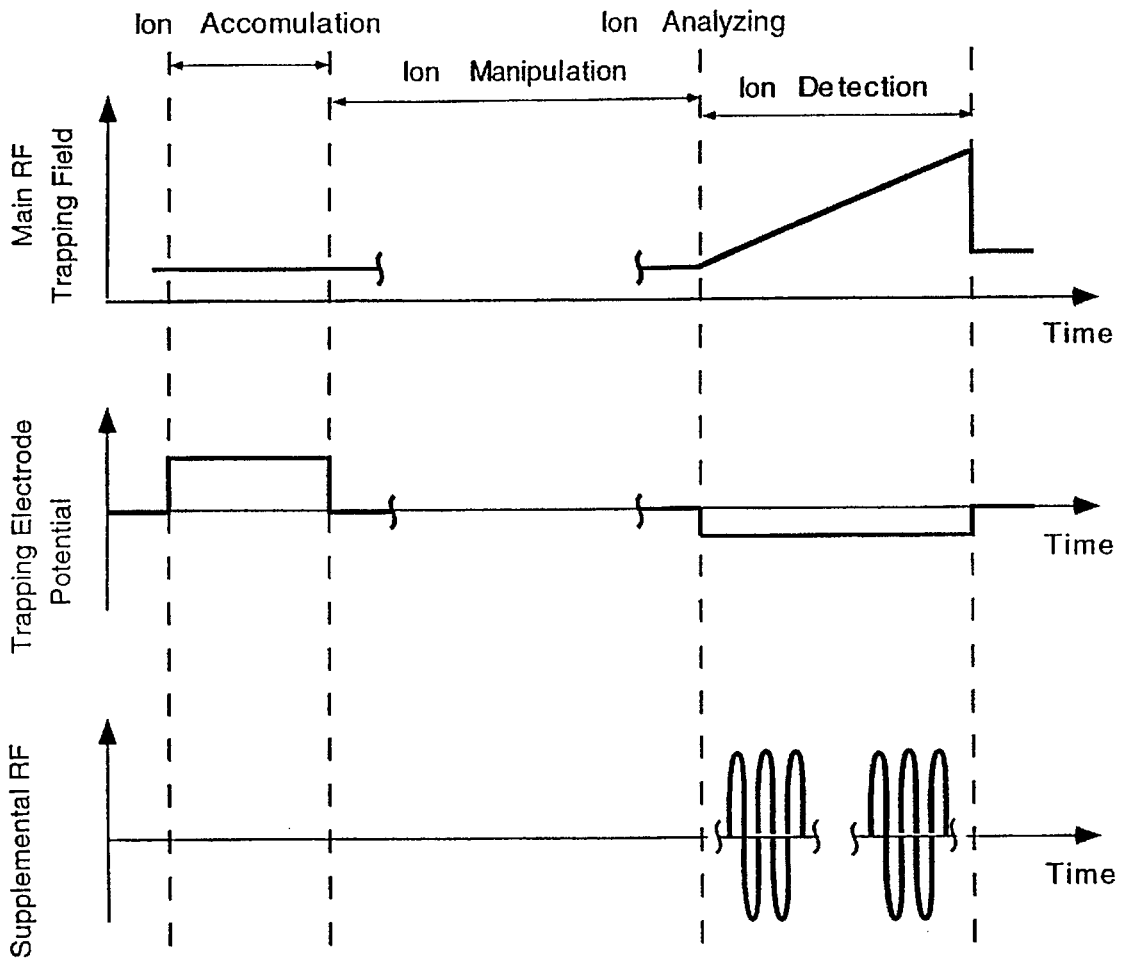
FIG. 6 shows a diagram of ions analyzing event sequence according to the present invention utilizing a threedimensional quadrupole ion trap.

In FIG. 6 a diagram of the ions analyzing event sequence is shown. During an ion accumulation stage a main RF trapping field is created within an ion trap, and externally produced ions are introduced into the ion trap, while the DC retarding voltage is applied to the trapping electrode. During an ion analyzing stage ions can be manipulated in a standard fashion: ions of a particular mass-to-charge ratio can be isolated in the trap as described in the U.S. Pat. No. 5,300,772, Buttrill, Jr., for example, and ion dissociation (MS/MS) can be accomplished as described in the U.S. Pat. No. 5,198,665, Wells et al. During a detection stage the retarding flinging field is turned off and ion detection technique is used as disclosed in the U.S. Pat. No. 4,736,101, Kelley et al., or the patent application No. 08/609,364, Wells et al., assigned to assignee of the present invention.

Figure 7:
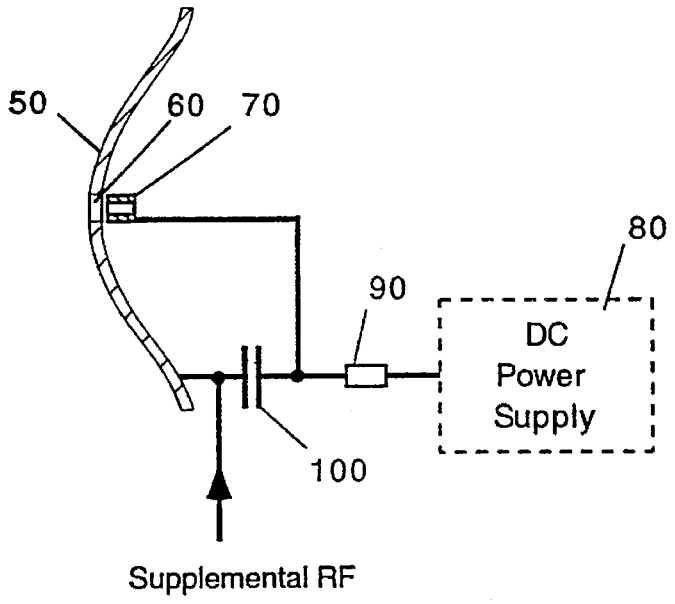
FIG. 7 shows an electrical diagram for coupling of DC power supply and supplemental RF voltage to the trapping electrode according to one of the embodiments of the present invention.

For ion detection, the potential of the trapping electrode can be adjusted by applying a bias DC voltage to the trapping electrode to provide an extracting fringing field for the trapped ions. This bias DC voltage is negative for the positive ions and positive for the negative ions. At the same time a supplemental bipolar radio-frequency voltage is applied to the end cap electrodes for the resonance ion ejection. When the frequency of this supplemental voltage is matched to the resonance frequency of the ions of a particular mass to charge ratio, these ions will become excited and eventually enter the fringing field exit region 65 to be expelled out of the ion trap to an ion detector such as an electron multiplier detector. To enhance the extraction of ions from the ion trap, a supplemental RF voltage from end cap electrode is applied to the trapping electrode which is under DC bias voltage as shown in FIG. 7. A DC voltage of power supply 80 is applied to trapping electrode 70 through RF filtering resistor 90, and supplemental RF voltage is applied to exiting end cup electrode 50 and to the trapping electrode 70 through decoupling capacitor 100. The typical frequency range for the supplemental voltage is from 40 kHz to 1 MHz and of the order of 10 V in amplitude. In practice, the frequency of the supplemental voltage can be constant and analyzed ions can be brought into resonance by changing the amplitude of the main RF voltage on the ring electrode.

Figure 8:
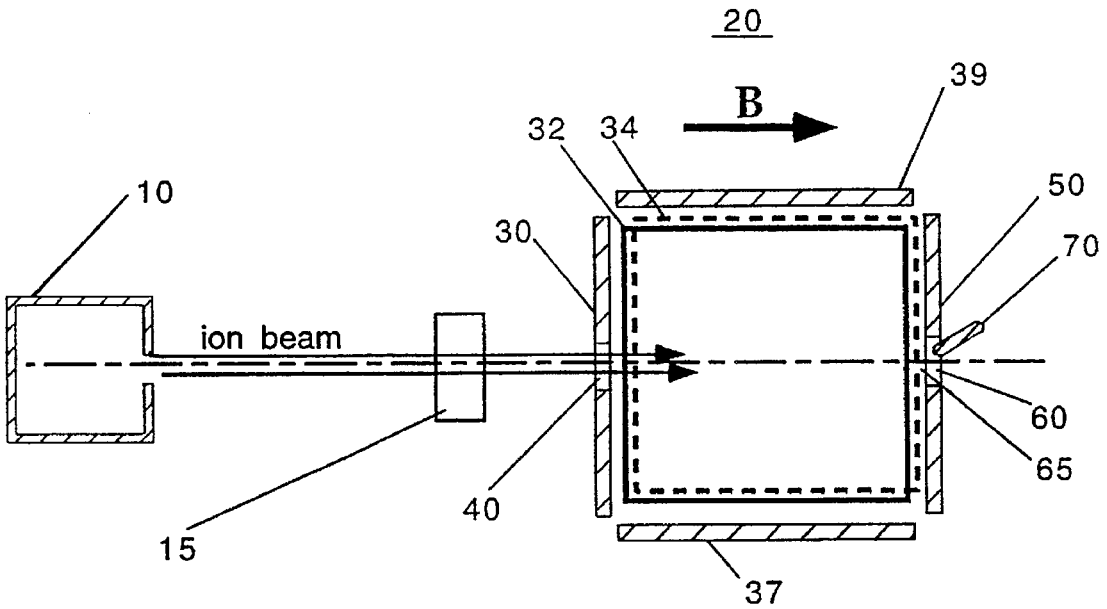
FIG. 8 shows a schematic illustration of the ion trap mass spectrometer system of the present invention utilizing an electromagnetic cubic trap for Fourie transform ion cyclotron resonance technique (FT ICR).
Figure 9:
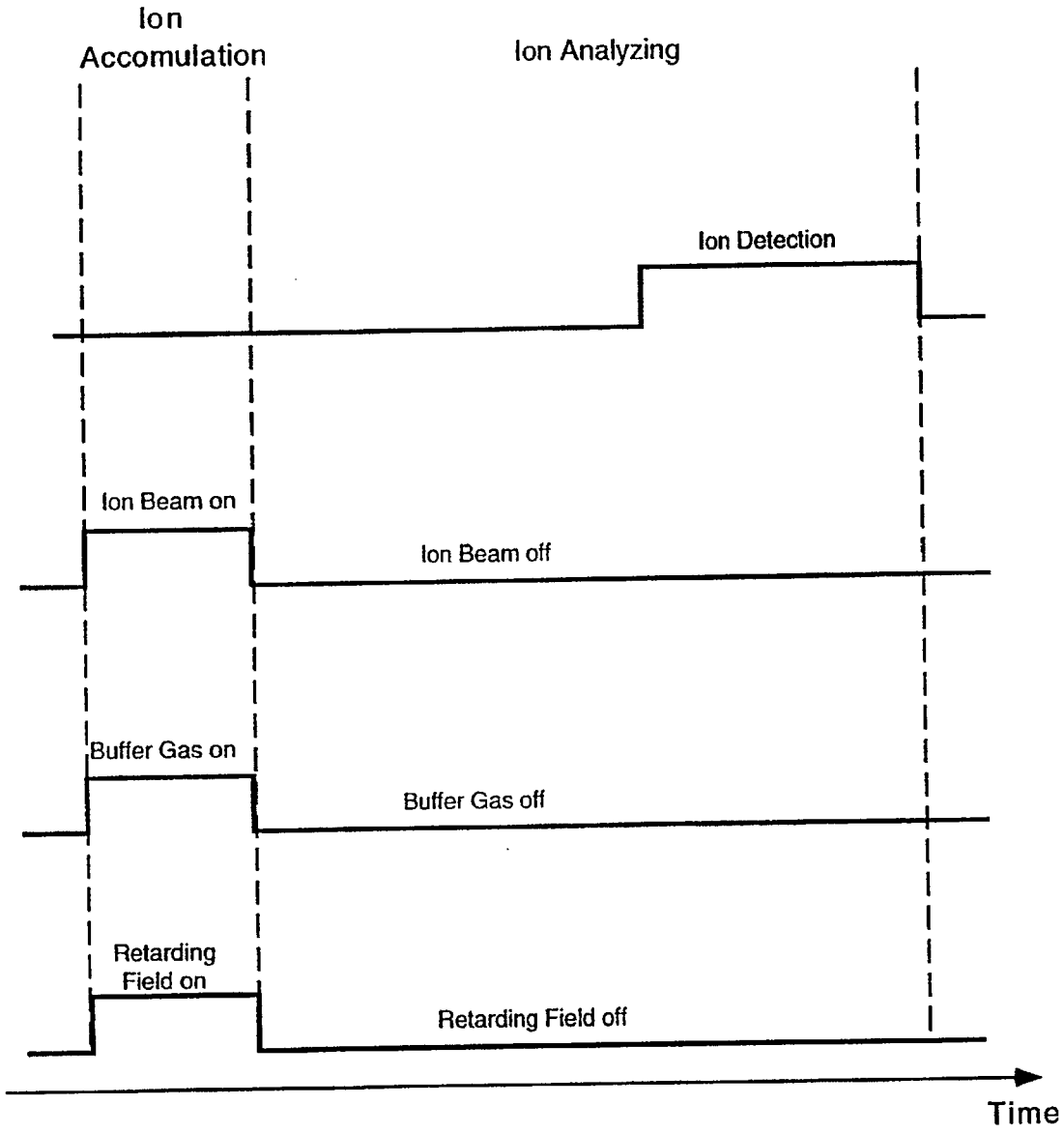
FIG. 9 shows a diagram of ion analyzing event sequence according to another embodiment of the present invention utilizing the ICR cell.

FIG. 8 shows schematically an electromagnetic cubic trap for FT ICR which is utilized in the ion trap mass spectrometer system of the present invention. Ions are introduced into ion trap 20 from an external source 10. The ion trap comprises two end cap electrodes 30, 50; two excitation electrodes 39, 37; two detection electrodes 32, 34 and trapping electrode 70. Ions enter the ion trap along the electromagnetic field B lines through entrance orifice 40 in the end cap electrode 30. The ion beam is gated to provide a time-controlled ion accumulation period using an ion gating device 15. Buffer gas, such as nitrogen, can be introduced in a pulse mode only during the ion accumulation period to facilitate ion trapping. During the ion accumulation time, the trapping electrode 70 potential is maintained at DC retarding potential to prevent ions from exiting the ion trap. After the ion accumulation time, this DC potential is switched to the potential of the end cap electrode 50. All conventional FT ICR techniques are applied for ion analyzed detection when the fringing field of the trapping electrode 70 is zero. The complete event sequence for an FT ICR method according to the present invention is shown in FIG. 9. During the ion accumulation stage an ion beam is introduced into the ion trap, a retarding field is created by applying DC voltage to the trapping electrode and buffer gas is introduced to the ion trap. During the ion analyzing stage the retarding field is turned off by switching DC voltage of the electrode to DC end cap electrode voltage, the buffer gas is pumped out, and ion signal is acquired.

It is well understood that the ion traps can be quadrupole ion traps or ICR cells of different geometries, including but not limited to cubic, cylindrical and open cylindrical geometries. It is optional to use a pulse of buffer gas during ion introduction for traps or a permanent pressure of a buffer gas can be maintained in the system. Different gases can be used as buffer gases, including inert or chemically reactive gases. Residual background gas in the vacuum system can also serve functionally as a buffer gas.

The present invention provides a mass spectrometer system with an adjustable trapping field geometry. The special retarding electrostatic fringing field dramatically increases the ion path length inside the trap for externally produced ions. This allows one to increase the trapping efficiency during the ion accumulation period for externally produced ions as well as operate with the buffer gas at lower pressure. For ion detection, the trapping field geometry is adjusted to provide optimum field geometry for detection.

What is claimed is:

1. An improved ion trap mass spectrometer system for trapping ions comprising:

an external ion source for producing an ion beam;

an ion trap for admitting said ion beam during ion accumulation time, said ion trap having spaced apart entrance and exit regions along an axis of the ion beam;

at least one trapping electrode placed in proximity to said exit region; and a power supply for applying a retarding DC voltage to said trapping electrode for creating a fringing reflecting field within said ion trap and for retaining said ions within said ion trap during said accumulation time, and applying a bias DC voltage to said trapping electrode during detection time.

2. The improved ion trap mass spectrometer system of claim 1, wherein said ion trap further comprising an entrance, an exit and side electrodes.

3. The improved ion trap mass spectrometer system of claim 2, wherein said entrance region is located between said entrance electrode and one of said side electrodes.

4. The improved ion trap mass spectrometer system of claim 2, wherein said entrance region and said exit region are located within said entrance electrode and exit electrode respectively.

5. The improved ion trap mass spectrometer system of claim 4, wherein said ion trap is a three dimensional quadruple ion trap.

6. The improved ion trap mass spectrometer of claim 4, wherein said ion trap is an ion cyclotron resonance cell.

7. An improved ion trap mass spectrometer system comprising:

an external ion source for producing an ion beam;

an ion trap positioned along an axis of said ion beam, said ion trap comprising:

an entrance electrode with an aperture for passing said ion beam therethrough;

an exit electrode with an orifice, said orifice facing said aperture;

a trapping electrode placed in proximity to said orifice; and a power supply for applying DC voltage to said trapping electrode to create a fringing reflecting field within said ion trap during ion accumulation time.

8. The improved ion trap mass spectrometer system of claim 7, further comprising a switch, said switch is connected to said power supply to change a value of said DC voltage applying during ion accumulation time to a value of DC voltage applying during ion detection time.

9. The improved ion trap mass spectrometer system of claim 8, wherein said trapping electrode is positioned along said ion beam axis.

10. The improved ion trap mass spectrometer system of claim 9, wherein said trapping electrode is an isolated portion of said exit electrode.

11. The improved ion trap mass spectrometer system of claim 9, wherein said trapping electrode has a hollow body with a central orifice.

12. The improved ion trap mass spectrometer system of claim 8, wherein said trapping electrode is placed inside said ion trap.

13. The improved ion trap mass spectrometer system of claim 8, wherein said trapping electrode is placed outside of said ion trap.

14. The improved ion trap mass spectrometer system of claim 13, wherein said trapping electrode is positioned off said ion beam axis.

15. The improved ion trap mass spectrometer system of claim 8, wherein said ion trap is a radio-frequency quadruple ion trap.

16. The improved ion trap mass spectrometer system of claim 8, wherein said ion trap is an ion cyclotron resonance cell.

17. The improved ion trap mass spectrometer system of claim 8, wherein said external ion source is a continuous ion source.

18. The improved ion trap mass spectrometer system of claim 8, wherein said external ion source is a pulsed ion source.

19. A method of trapping ions produced by an external ion source into an ion trap comprising the steps of:

directing said ions through an entrance region for said ions into said ion trap;

providing at least one trapping electrode at an exit region for said ions from said ion trap, said entrance and exit regions being on an axis of said ion beam; and applying a retarding DC voltage to said trapping electrode during an ion accumulation time for retaining the ions within said ion trap.

20. The method of claim 19, wherein said trapping electrode is positioned on said ion beam axis.

21. The method of claim 19, wherein said trapping electrode is positioned off said beam axis.

22. A method of trapping and analyzing ions within an ion trap comprising the steps of:

providing said ion trap with entrance and exit electrodes with respective aperture and orifice facing each other;

positioning a trapping electrode in proximity to said orifice;

filling said ion trap with a buffer gas;

producing an external ion beam form an external ion source;

directing said ion beam into said ion trap through said aperture during ion accumulation time; and applying a retarding DC voltage to said trapping electrode during said ion accumulation time.

23. The method of trapping and analyzing ions of claim 22, further comprises the step of detecting ions trapped within said ion trap during ion detection time.

24. The method of trapping ions within an ion trap of claim 23, wherein said step of detecting ions further comprising the step of applying a bias DC voltage to said trapping electrode during said ion detection time.

25. The method of trapping ions within an ion trap of claim 24, wherein said bias DC voltage is substantially equal to a DC potential of said exit electrode of said ion trap.

26. The method of trapping and analyzing ions of claim 24, further comprises a step of applying a supplemental RF voltage to said ion trap during said ion detection time.

27. The method of trapping and analyzing ions of claim 26, wherein said supplemental RF voltage is applied to said trapping electrode and between said entrance and exit electrodes of said ion trap.

* * * * *